US005253694A

United States Patent [19]

Bernardo

[11] Patent Number: 5,253,694

[45] Date of Patent: Oct. 19, 1993

[54] ROLLING SHUTTER SLAT END RETAINER

[76] Inventor: Richard G. Bernardo, 2350 NE. 29th St., Lighthouse Point, Fla. 33064

[21] Appl. No.: 800,622

[22] Filed: Nov. 27, 1991

[51] Int. Cl.[5] ..... E06B 9/07

[52] U.S. Cl. ..... 160/133; 160/201; 160/232; 160/236

[58] Field of Search ..... 160/133, 201, 202, 232, 160/235, 236

[56] References Cited

U.S. PATENT DOCUMENTS

| | | | |
|---|---|---|---|
| 949,789 | 2/1910 | Wilson | 160/235 |
| 1,707,287 | 4/1929 | Sudzki | 160/232 |
| 1,943,371 | 1/1934 | Cross | 160/235 X |
| 3,799,237 | 3/1974 | Proserpi | 160/232 X |
| 4,037,639 | 7/1977 | Jones | 160/232 X |
| 4,365,660 | 12/1982 | Henkenjohann | 160/133 |

FOREIGN PATENT DOCUMENTS

| | | | |
|---|---|---|---|
| 3638969 | 5/1988 | Fed. Rep. of Germany | 160/133 |
| 425165 | 5/1967 | Switzerland | 160/133 |
| 2056534 | 3/1981 | United Kingdom | 160/133 |
| 2220692 | 1/1990 | United Kingdom | 160/133 |

*Primary Examiner*—David A. Scherbel
*Assistant Examiner*—Derek J. Berger
*Attorney, Agent, or Firm*—Malin, Haley, DiMaggio & Crosby

[57] ABSTRACT

An improvement in rolling shutters that includes a slat end retainer attached to the ends of individual shutter slats contoured and configured for securing a slat end to the side track which allows the shutters to endure high velocity winds, substantial impact, or attempted forced entry without conventional storm braces. The retainer end includes a pair of contoured inner and outer flanges formed from a unitary body which has a predetermined sized slot that is keyed to fins in each vertical side track to prevent disengagement of the slat from the track.

6 Claims, 2 Drawing Sheets

ROLLING SHUTTER SLAT END RETAINER

BACKGROUND OF THE INVENTION

1. Field of the Invention

This invention relates generally to an improvement in rolling shutters and, in particular, to an improved rolling shutter having slat end retainers which secure the shutter slats to the vertical side tracks for withstanding high wind velocities or resisting forced entries without disengagement of the slat ends from the track.

2. Description of the Prior Art

Rolling shutters are well known in the prior art. Typically, the shutters are used to cover windows, doors, lanais, and all other fenestrations in homes and buildings for protection against violent storms, burglars, heat and cold (as an insulator), and for privacy. Each rolling shutter is typically comprised of elongated plastic (PVC) or aluminum slats hinged together along their top and bottom edges and disposed horizontally between a pair of vertical side tracks anchored to a building which allow for vertical movement of the shutter slats into a stored rolled up position overhead. The roll diameter, therefore, of the entire slat mechanism is important so that the shutter can be rolled up into a small space out of the way when not in use. Another important aspect is that the shutter slats freely move in the vertical tracks and do not jam.

One major problem with conventional rolling shutters, especially in geographical areas where high winds (such as hurricanes) can be expected periodically or areas of high crime where forced entries can be anticipated, is the lack of structural integrity between the slats and tracks, dictated by the typical roll-up shutter design and the constraints of building aesthetics. Practical considerations in building construction also dictate rolling shutter structures inasmuch as often the shutters are mounted over windows in tall buildings several floors above the ground level, making the shutter exterior difficult to access from the building outside.

To enhance roller shutter structural integrity for specific short periods of time, such as during tropical storms, rolling shutters have employed (where accessible) storm braces which are mounted vertically at predetermined spaced lateral intervals across the shutter (front and back) to provide additional strength to prevent buckling and bowing of the slats caused by ambient pressure variations (positive and negative) generated by high winds. The problem with storm bars are that they are aesthetically undesirable, costly, and present practical mounting problems either because of their location making them inaccessible in high rise buildings for installation or removal. However, without such storm bars or reinforcement bars, force generated by high wind velocities typically push inwardly or pull outwardly (ambient pressure either positive or negative), causing the slat(s) to bow, reducing their effective length between shutter tracks forcing the slats from the side tracks. To overcome the problem of slat disengagement at wind loads required by various building codes, slat span lengths are greatly reduced, especially if storm bars are not available.

In trying to provide a shutter structure that can resist high wind velocities (pressures) without disengagement, one must always consider the roll-up nature of the shutter and the requirement that the slats do not get jammed in upward or downward movement of the slats relative to the side tracks.

The present invention overcomes the problems presented in the prior art by providing slat end retainers and a track configuration which are constructed in such a way to prevent a slat end from being disengaged from the track with the capability of withstanding extremely high winds, while at the same time allowing for conventional type operation of the rolling shutter with respect to roll-up storage. A further benefit is that the present invention does not increase noise or vibration in the engagement of the slat end retainers in the tracks. Finally, the track engagement feature in accordance with the present invention, as determined by the contour and shape of the slat end retainer, eliminates any possibility of jamming of the slats during up and down movement of the slats.

To use the present invention, a slat end retainer is placed at each end of a slat of alternating slats vertically (every other slat) or in areas of lower wind velocity expectations, every third slat. Therefore, the slat end retainers in accordance with the present invention need not be employed in every slat.

SUMMARY OF THE INVENTION

An improved rolling shutter that includes a slat end retainer fastened to each end of a shutter slat which is secured to a pair of vertically mounted side tracks, and is moveably keyed thereto. Each slat retainer end is comprised of a rigid molded body and includes a first portion or segment (called a stem) that is sized in length, width, and thickness and contoured as the inside profile of a hollow slat. The stem segment fits substantially into the end portion interior of a slat. The stem has curved inside and outside walls which engage the inside and outside slat walls on the interior for a snug fit. The stem length or penetration into the slat end may be as desired by the overall stress load, but should be approximately 2" to allow for the anchoring of the end retainer to the slat by a plurality of rivets which pass through at least one wall of the slat into the slat end retainer stem and to withstand compression or tension forces at the slat ends.

The second portion or segment of the slat end retainer body integrally formed with the stem includes an enlarged end cap formed by a pair of inner and outer flanges rising above the surface defined by the stem, said inner and outer flanges in conjunction with a web portion forming a slot on front and back sides of each end retainer. The web slot is received into a track throat, explained in greater detail below. The outside shape of the peripheral rim defined by the raised inner and outer flanges include arcuate front and back segments and curved ends that are sized to conform with the outside shape (perimeter) around each slat end in cross-section. The top and bottom flange periphery is slightly larger than the slat exterior profile to act as a lateral stop to the slat end. Thus, the end outside face of the slat conforms perfectly with the inner flange surface at each end of the end slat. The lateral thickness of the outer flange at top and bottom is important to the invention in that the outer flange must be sufficiently thick to withstand the maximum lateral anticipated forces applied to the slats. Another important dimensional aspect to ensure jamproof operation is the lateral size of the slot formed between the inner and outer flanges and, in fact, the distance between the outer wall of the inner flange and the outer wall of the outer flange. There is enough lateral play or space to ensure that the outer surface or outer wall of the inner flange cannot contact the track fin o either side of the throat regardless of how far laterally the slat and end retainer are pushed. Thus, the outside wall of the outer flange can contact the track wall formed in the track chamber and still move freely upward and downwardly. The slot between the inner and outer flanges is such and the thicknesses of the flanges determined so that even if the outside wall of the outer flange is flush and pressed against the track chamber wall, the inner flange cannot contact the track fin at all. This ensures that there be no binding or frictional drag incurred and that the track fins will in no way impede upward and downward movement of the end retainer and, therefore, the slats. By having these dimensions on both sides, the end retainer slats and slot provide for self-alignment of the slats in the tracks to prevent jamming.

Each vertical side track is formed as an extruded aluminum rectangular tube essentially having one open side and having internally a pair of internal chambers. The first chamber is completely enclosed with four rectangular side walls and is essentially used for mounting the track to a wall surface adjacent the fenestration to be covered by the rolling shutter. This closed rectangular chamber is conventional and does not form a part of the invention. The second chamber, however, includes a back wall and a pair of parallel fins that lie in the same plane and are parallel to the back wall with an open space between them called the throat, forming a partially closed chamber adjacent the side opening in the entire aluminum rectangular tube. The distance between the track internal wall and the fins is strategically determined in conjunction with the width of the slot between the inner and outer flanges on the end retainer to ensure that when the outer wall of the outer flange is flush against the surface of the track wall, the inner flange will not touch either of the fins. The track rectangular tube along its open side includes a pair of grooves for receiving a polypropylene guide which prevents metal to metal contact between the slats and acts to reduce noise and dust entrance. The polypropylene guide is conventional and is not part of the invention.

Important considerations are to provide sufficient mass in the end retainer to insure that pressures created by high winds or other forces on the slats tending to bow or curve the slats are offset by sufficient mass of the end retainer to prevent structural failure and, therefore, its disengagement from the track while at the same time it is essential to ensure that the configuration of the end retainer is shaped an sized peripherally such that the slats can be rolled up in storage.

The stem of each end retainer is inserted into a slat up to the inner flange. Rivets are applied through the slat wall into the stem at a predetermined edge distance from the slat end which prevents breakage of the slat along the edge.

It is an object of this invention to provide an improved rolling shutter mechanism in which the slats cannot become disengaged from their side tracks regardless of wind velocities, forced entries or other positive and negative ambient pressure forces.

It is another object of this invention to provide an improved rolling shutter mechanism that includes slat end retainers that are jamproof and self-aligning.

Still another object of this invention is to provide an improved rolling shutter system having a improved track and slat securing system that eliminates the need for storm bars.

In accordance with these and other objects which will be apparent hereinafter, the instant invention will now be described with particular reference to the accompanying drawings.

PREFERRED EMBODIMENT OF THE INVENTION

Figure 1:
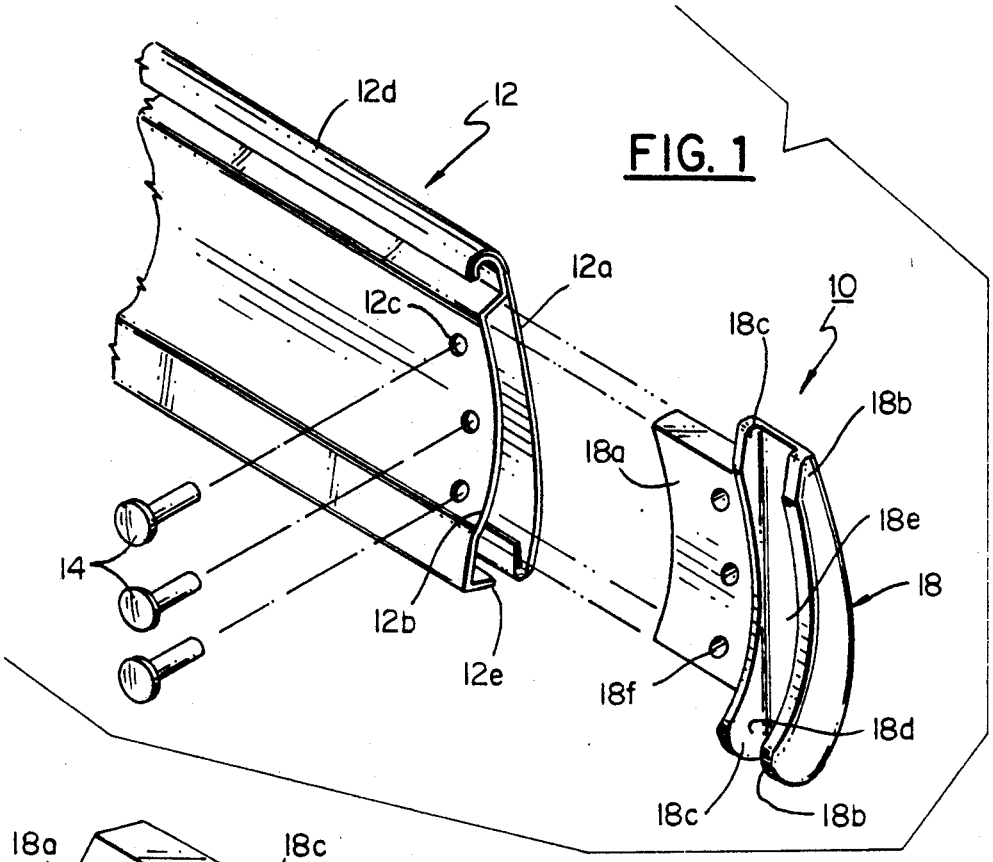
FIG. 1 shows an exploded perspective view cut away of the rolling shutter slat and a slat end retainer in accordance with the present invention.

Referring now to the drawings and specifically FIG. 1, end retainer 10 in accordance with the present invention is shown. In particular, a conventional slat 12 (aluminum or PVC) having an outer curved plastic or metal wall 12*a* is joined with an inner curved slat wall 12*b* forming a hook 12*d* along the top of the two slat walls joined together and a female hook connector opening 12*e* at the bottom which allows the slats to be connected together along their top and bottom edges 12*d* and 12*e* for hinged movement, all of which are conventional. The slat 12 interior is hollow and could contain a foam material.

The slat end retainer 10 is comprised of a unitarily formed (molded) rigid plastic (PVC or nylon body 18) which has a first segment 18*a*, termed "the stem" which has arcuate front and back walls to match the arcuate profile of slat walls 12*a* and 12*b* and has a thickness and smooth curved surfaces so that the stem 18*a* fits snugly into the slat interior between walls 12*a* and 12*b*.

The slat end retainer stem 18*a* extends laterally into the slat interior a sufficient distance to provide proper edge mounting for a plurality of rivets 14 which are mounted from the inside curved wall 12*b* into the interior, forming apertures 18*f* in stem 18*a* of the slat end retainer. A sufficient distance (approximately 2 inches) laterally of the stem 18*a* of penetration into the slat for mounting is required for structural integrity and to ensure that the end wall edges of the slats 12 do not crack or get ripped under lateral or twisting forces.

The second segment of the slat end retainer 10 has an outer flange 18*b* and an inner flange 18*c* having larger peripheral profiles than stem 18*a*. The profile of the flanges matches the slat 12 end profile, but is larger so that when stem 18*a* is inserted into the slat 12, the inner flange 18*c* will stop lateral movement and abut the end edge surface of slat walls 12*a* and 12*b*, thereby vertically aligning the slat edges. The inner and outer flanges 18*b* and 18*c* are parallel and form a slot of a predetermined width 18*d* on both sides of the end retainer 10 at top and bottom that ends in the interior curved planar surface 18*e* (which itself is contoured in the outer and inside walls to conform to the arcuate shape of slat walls 12*a* and 12*b*). The slot 18*d* formed by flanges 18*b* and 18*c* is critical to the operation of the invention and is received into a track throat formed by track tins as shown in FIG. 2.

Figure 2:
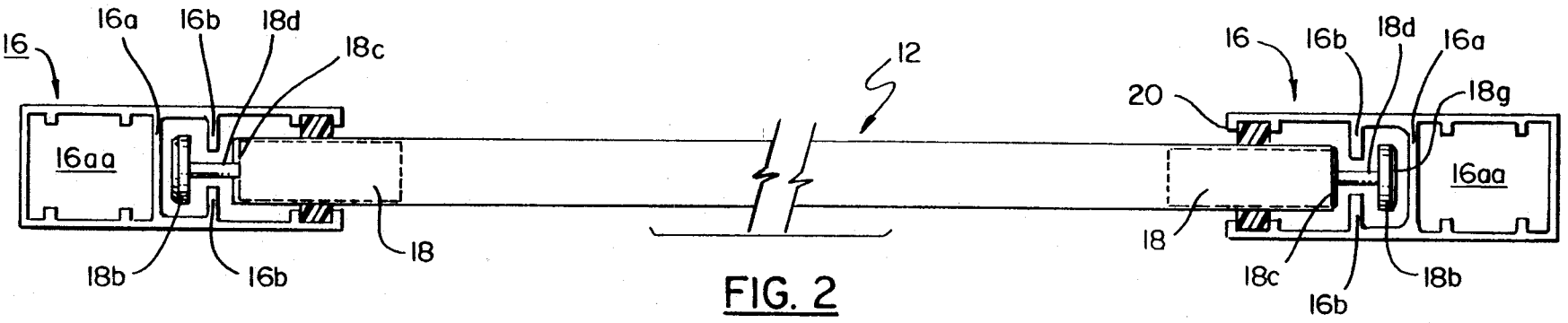
FIG. 2 shows a top plan view partially in cross-section showing an entire slat cut away in the middle of the present invention.
Figure 3:
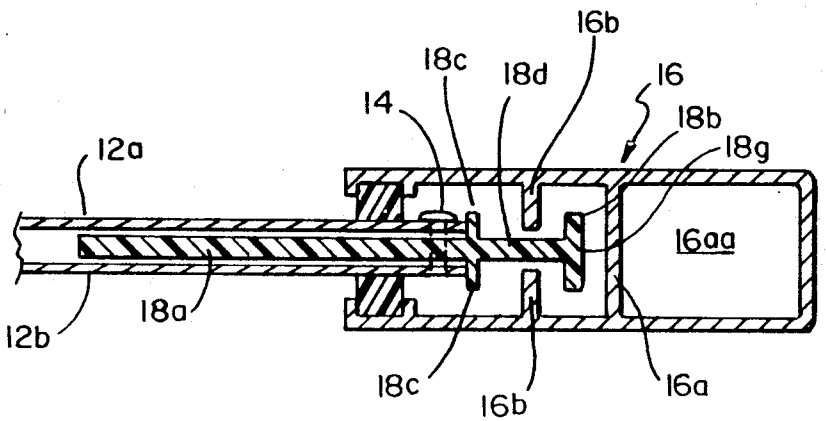
FIG. 3 shows a top cross-sectional view cut away of one end of a slat and the track.

FIGS. 2 and 3 show a slat 12 of indeterminate length secured at each end to tracks 16 with end retainers 18. The tracks 16 are constructed preferably of extruded aluminum and include a rectangular tube having a closed end chamber 16aa and a second chamber formed by a pair of fins 16*b* which form an open throat that receives the web between slot 18*d* formed by flanges 18*b* and 18*c* on each end retainer, with the throat space between the fins 16*b* being predetermined so that the outer flange 18*b* cannot pass through the throat formed between fins 16*b* in each track 16. The thickness laterally also of each fin 16*b* is strategically determined in conjunction with the thickness of slot 18*d*. This is referred to as the lateral movement tolerance and, as such, acts as a self-aligning, anti-jamming feature of the device. In particular, there should be sufficient spacing in slot 18*d* between the outside wall of flange 18*b* (the wall away from the slat 12) and the outside wall of flange 18*c* for lateral movement (tolerance) from side to side that if the outside wall 18*g* of outer flange 18*b* engages track wall 16*a*, the outside wall of inner flange 18*c* will not contact fins 16*b*. Note also under heavy wind conditions when slat 12 becomes curved, the perpendicular relationship between the slot 18*d* and flange 18*b* will cause the flange 18*b* to be angularly disposed relative to the channel fins 16*b*, providing tremendous holding force of the end retainer withstanding lateral disengagement of the slat from the throat because of fins 16*b*.

Because the outside contour of the slat end retainer is the same as that of the slat outside in curvature and size, the use of the end retainers will not change the volume of storage space required by the rolled up slats. The end slat retainers also act to laterally guide and prevent excessive lateral movement of the slats. This is accomplished by engagement of the inner flange 18*d* with adjacent (above and below) slats. In geographical areas where hurricanes or very high winds are expected, the present invention is constructed so that every other slat is secured to the tracks with end retainers. This insures maximum strength of the rolling shutter mechanism to prevent disengagement of the slats from either track. In areas of lesser expected winds, the invention could be made with slat end retainers being used on every third slat.

Figure 4:
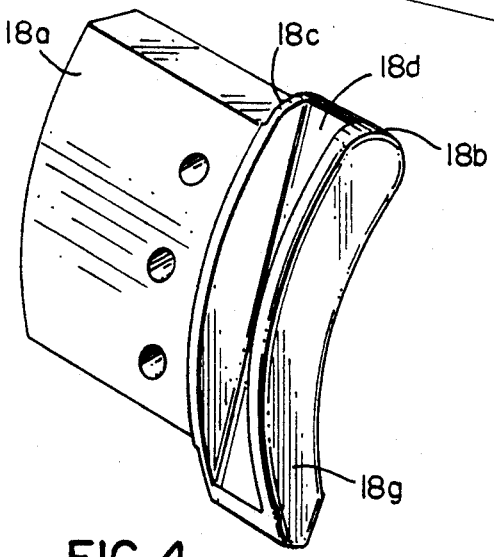
FIG. 4 is a perspective end view of an end retainer.

FIG. 4 shows a perspective view of the present invention including outer flange 18*b*, slot 18*d*, and inner flange 18*c* which form a second segment which is integrally connected to stem segment 18*a*. The end surface 18*g* of flange 18*b* is substantially flat while the contour of flange 18*b* is curved and arcuate on inner and outer sides following the overall profile of the slat.

Figure 5:
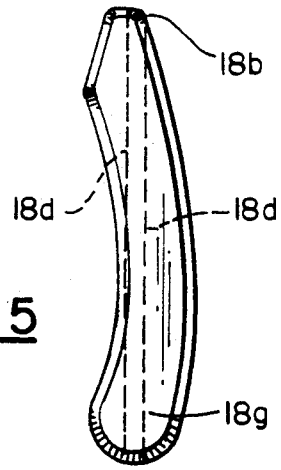
FIG. 5 is an end elevational view of the outer flange end of an end retainer.

FIG. 5 shows a side end view from top to bottom that shows the peripheral or perimeter profile of flange 18*b* and its relationship to the slot wall 18*d* which is flat on both sides to permit ease of movement in the track mechanism. Note that the profile of flange 18*b* formed by the surface 18*g* which is flat matches that of a conventional slat.

Figure 6:
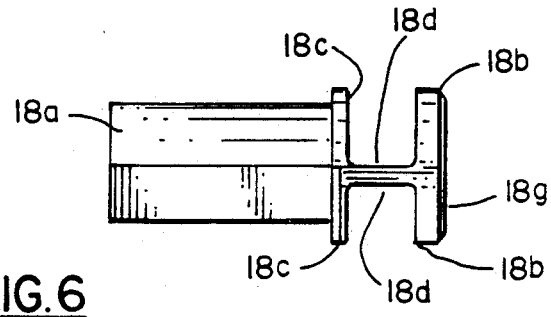
FIG. 6 is a top plan view of an end retainer.

FIG. 6 shows a top view in which the slot 18*d* walls are flat from top to bottom (also shown in FIG. 5) while stem 18*a* is arcuate as are the flanges 18*c* and 18*d* being outwardly curved from the top to the bottom of the slat end retainer.

In summary, the present invention greatly improves the aesthetic utilization of rolling shutters and reduces o eliminates the use of storm bars. High rise buildings are one example. Practical shutter span lengths are increased. The structural integrity of a rolling shutter is greatly enhanced while reducing production costs. These advantages are achieved with anti-jamming features without increasing storage size.

The invention has been shown and described herein in what is considered to be the most practical and preferred embodiment. It is recognized, however, that departures may be made therefrom within the scope of the invention and that obvious modifications will occur to a person skilled in the art.

What I claim is:

1. A rolling shutter having hollow slats said slats having first and second inside walls and said slats having C-shaped end guide tracks for guiding said slats during movement, said shutter being capable of being rolled up for storage, said shutter including:

a plurality of slat and retains, each secured to a slat end for interaction with a guide track, each of said slat end retains including a rigid body having a first segment sized and contoured to fit snugly inside one end of a hollow slat for a distance at least sufficient for attaching said rigid body to one end of a slat;

said body having a second segment including a web extending away from said first body segment, said body having a proximal end and a distal end relative to a slat, a web extending away from said first body segment toward said distal end;

a pair of flanges connected to said web and extending above said web at said distal end of said rigid body away from said first segment; said pair of flanges connected to said web and spaced apart forming a channel for engagement with said C-shaped guide track; and said guide track means including a pair of rigid coplanar fins separated by an opening, said fin opening being smaller than said distal end flanges, said web passing through said fin opening whereby said distal end flange is movably keyed to said guide track, thereby securing said slat at each end whereby the wind loading on each slat is enhanced such that said wind load cannot remove said slat end retainers from said guide track.

2. The apparatus of claim 1 wherein said means for attaching said stem to said slat includes at least one rivet.

3. The apparatus of claim 1 wherein said web, said flange and said stem are unitarily manufactured of the same material.

4. The apparatus of claim 3 wherein said web, said flange and said stem are manufactured of a plastic material.

5. A slat fastening system for increasing the wind loading for a rolling shutter for windows, lanais, or other fenestration having slats with opposing vertical side guide tracks with co-planar separated fin walls for securing said shutter slats to said guide tracks despite displacement forces on said shutter slats from high winds or forced entries and the like comprising:

at least two slat end retainers, each of said slat end retainers including a rigid, solid body attachable to each end of a slat, said solid body including a contoured stem said stem having walls shaped to snugly fit in each of said hollow salt ends;

means for attaching said stem to said slat;

a web extending away from said stem;

an outer flange, attached to said web opposite said stem, said outer flange larger peripherally than said web;

an inner flange attached to said web closer to said stem than said outer flange;

a pair of guide tracks, each corresponding to said opposing ends of said slats, each guide track having a slat chamber having a first and a second end, said slat chamber open at said first end to receive said end of said slat;

a track retaining chamber, adjacent said track slat chamber at said second end of said slat chamber, said retaining chamber adapted to receive said outer flange; and a wall between said track slat chamber and said track retaining chamber having a web aperture sized to allow said web to be disposed in said web aperture, said web aperture being smaller than said outer flange so that said outer flange may not phase out of said retaining chamber into said slat chamber through said web aperture, whereby said slats are secured within said track by said outer flange being retained within said retaining chamber.

6. An apparatus as in claim 5, including:

said inner flange mounted on said web and said outer flange being contoured in shape to conform to the peripheral contour of a hollow slat, said inner flange forming with said outer flange a slot therebetween with said web, said slot being sized so that said inner and outer flanges cannot conflict with said fin walls when maximum lateral movement occurs.

* * * * *

UNITED STATES PATENT AND TRADEMARK OFFICE

CERTIFICATE OF CORRECTION

PATENT NO. : 5,253,694
APPLICATION NO. : 07/800622
DATED : October 19, 1993
INVENTOR(S) : Richard G. Bernardo It is certified that error appears in the above-identified patent and that said Letters Patent is hereby corrected as shown below:

In the Claims:

At Column 6, line 18, "and retains," should be -- end retainers, --.

At Column 6, line 20, "retains," should be -- retainers --.

At Column 6, line 65, "salt," should be -- slat --.

At Column 8, line 2, "phase," should be -- pass --.

Signed and Sealed this

Thirtieth Day of September, 2008

JON W. DUDAS
*Director of the United States Patent and Trademark Office*